US008756934B2

(12) United States Patent
Melton et al.

(10) Patent No.: US 8,756,934 B2
(45) Date of Patent: Jun. 24, 2014

(54) COMBUSTOR CAP ASSEMBLY

(71) Applicant: General Electric Company, Schenectady, NY (US)

(72) Inventors: Patrick Benedict Melton, Horse Shoe, NC (US); Bryan Wesley Romig, Simpsonville, SC (US); Lucas John Stoia, Taylors, SC (US)

(73) Assignee: General Electric Company, Schenectady, NY (US)

( * ) Notice: Subject to any disclaimer, the term of this patent is extended or adjusted under 35 U.S.C. 154(b) by 46 days.

(21) Appl. No.: 13/663,712

(22) Filed: Oct. 30, 2012

(65) Prior Publication Data

US 2014/0116066 A1 May 1, 2014

(51) Int. Cl.

| | |
|---|---|
| ***F23R 3/28*** | (2006.01) |
| ***F02C 7/22*** | (2006.01) |
| *F02C 7/18* | (2006.01) |
| *F23R 3/14* | (2006.01) |

(52) U.S. Cl.

CPC . *F23R 3/286* (2013.01); *F23R 3/14* (2013.01); *F23R 3/28* (2013.01); *F23R 2900/03044* (2013.01)

USPC ..... 60/737; 60/747; 60/746; 60/748

(58) Field of Classification Search

USPC ..... 60/737, 747, 804, 742, 748, 746, 39.83; 239/132.3, 132.5; 431/116

See application file for complete search history.

(56) References Cited

U.S. PATENT DOCUMENTS

| | | | | |
|---|---|---|---|---|
| 5,274,991 | A | 1/1994 | Fitts | |
| 5,357,745 | A | 10/1994 | Probert | |
| 6,604,286 | B2 * | 8/2003 | Halila et al. | 29/890.02 |
| 6,923,002 | B2 | 8/2005 | Crawley et al. | |
| 6,981,358 | B2 * | 1/2006 | Bellucci et al. | 60/39.17 |
| 7,007,477 | B2 * | 3/2006 | Widener | 60/737 |
| 8,079,218 | B2 * | 12/2011 | Widener | 60/742 |
| 8,312,722 | B2 * | 11/2012 | York et al. | 60/737 |
| 8,333,075 | B2 * | 12/2012 | York et al. | 60/748 |
| 8,616,002 | B2 * | 12/2013 | Kraemer et al. | 60/737 |
| 2002/0162333 | A1 * | 11/2002 | Zelina | 60/776 |

(Continued)

FOREIGN PATENT DOCUMENTS

| | | | | |
|---|---|---|---|---|
| EP | 2466205 | A1 * | 6/2012 | F23R 3/10 |
| EP | 2578943 | A2 * | 4/2013 | F23R 3/28 |

OTHER PUBLICATIONS

Search Report from EP Application No. 13189537.7 dated Jan. 2, 2014.

*Primary Examiner* — Ehud Gartenberg
*Assistant Examiner* — Jason H Duger
(74) *Attorney, Agent, or Firm* — Dority & Manning, PA

(57) ABSTRACT

A combustor generally includes a shroud that that defines at least one inlet passage extends circumferentially inside the combustor. A first plate extends radially inside the shroud downstream from the inlet passage. The first plate defines at least one inlet port, at least one outlet port and at least partially defines at least one fuel nozzle passage. The shroud at least partially surrounds a sleeve that extends around the fuel nozzle passage. A tube at least partially surrounded by the sleeve may extend through the fuel nozzle passage. The tube, the sleeve, and the first plate may at least partially define an outlet passage. A first fluid flow path generally extends from the at inlet passage to the inlet port, and a second fluid flow path extends generally from the outlet port to the outlet passage.

20 Claims, 6 Drawing Sheets

(56) References Cited

U.S. PATENT DOCUMENTS

| | | | | |
|---|---|---|---|---|
| 2005/0268614 | A1 | 12/2005 | Widener | |
| 2009/0188255 | A1 | 7/2009 | Green et al. | |
| 2010/0050640 | A1 | 3/2010 | Belsom et al. | |
| 2010/0162713 | A1 | 7/2010 | Li et al. | |
| 2010/0242493 | A1 | 9/2010 | Cihlar et al. | |
| 2011/0179795 | A1* | 7/2011 | Johnson et al. | 60/725 |
| 2011/0197586 | A1 | 8/2011 | Berry et al. | |
| 2012/0060511 | A1 | 3/2012 | Zuo et al. | |
| 2012/0180490 | A1* | 7/2012 | Takami et al. | 60/740 |
| 2012/0192566 | A1* | 8/2012 | Uhm et al. | 60/740 |

* cited by examiner

COMBUSTOR CAP ASSEMBLY

FIELD OF THE INVENTION

The present invention generally involves a combustor and method for cooling the combustor.

BACKGROUND OF THE INVENTION

Gas turbines often include a compressor, a number of combustors, and a turbine. Typically, the compressor and the turbine are aligned along a common axis, and the combustors are positioned between the compressor and the turbine in a circular array about the common axis. In operation, the compressor creates a compressed working fluid, such as compressed air, which is supplied to the combustors. A fuel is supplied to the combustor through one or more fuel nozzles and at least a portion of the compressed working fluid and the fuel are mixed to form a combustible fuel-air mixture. The fuel-air mixture is ignited in a combustion zone that is generally downstream from the fuel nozzles, thus creating a rapidly expanding hot gas. The hot gas flows from the combustor into the turbine. The hot gas imparts kinetic energy to multiple stages of rotatable blades that are coupled to a turbine shaft within the turbine, thus rotating the turbine shaft and producing work.

To increase turbine efficiency, modern combustors are operated at high temperatures which generate high thermal stresses on various components disposed within the combustor. As a result, at least a portion of the compressed working supplied to the combustor may be used to cool the various components. For example, many modern combustors may include a generally annular cap assembly that at least partially surrounds the one or more fuel nozzles. The cap assembly may generally provide structural support for the one or more fuel nozzles, and may at least partially define a flow path for the fuel-air mixture to follow just prior to entering the combustion zone. Certain cap assembly designs may include a generally annular cap plate that is disposed at a downstream end of the cap assembly and that is adjacent to the combustion zone. As a result, the cap plate is generally exposed to extremely high temperatures, thus resulting in high thermal stresses on the cap plate.

Current cap assembly designs attempt to mitigate the high thermal stresses by directing a portion of the compressed working fluid to the cap assembly and through multiple cooling holes which extend through the cap plate surface. This method is known in the industry as effusion cooling. However, the compressed working fluid flowing through the multiple cooling holes may enter the combustion zone generally unmixed with the fuel. As a result, NOx and/or $CO_2$ generation may be exacerbated and turbine efficiency may be decreased. Therefore, a combustor that provides cooling to the cap assembly and improves pre-mixing of the compressed working fluid with the fuel for combustion would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor having a shroud that extends circumferentially inside the combustor. The shroud may define at least one inlet passage. A first plate may extend radially inside the shroud downstream from the at least one inlet passage, where the first plate defines at least one inlet port, at least one outlet port and at least partially defines at least one fuel nozzle passage. A sleeve may be at least partially surrounded by the shroud and may extend circumferentially around the at least one fuel nozzle passage. The sleeve generally extends from the first plate radially outward from the at least one fuel nozzle passage. A tube may be at least partially surrounded by the sleeve and may extend through the at least one fuel nozzle passage. The tube, the sleeve, and the first plate may at least partially define an outlet passage. The combustor may further include a first fluid flow path that extends from the at least one inlet passage to the at least one inlet port, and a second fluid flow path that extends from the at least one outlet port to the at least one outlet passage.

Another embodiment of the present invention is a combustor having a shroud that extends circumferentially inside the combustor and that defines at least one inlet passage. A first plate extends radially inside the shroud downstream from the at least one inlet passage. The first plate defines at least one inlet port, at least one outlet port and at least one fuel nozzle passage. A second plate extends radially around the first plate downstream from the at least one inlet port and upstream from the at least one outlet port. A sleeve may be at least partially surrounded by the shroud and may extend radially around the at least one fuel nozzle passage. The sleeve generally extends from the first plate radially outward from the at least one fuel nozzle passage. A tube may extend through the at least one fuel nozzle passage. The tube, the sleeve, and the first plate may at least partially define an outlet passage. An inlet plenum may be defined may be at least partially defined by the shroud, the first plate and the sleeve. An outlet plenum may be disposed downstream from the inlet plenum and at least partially defined by the sleeve, the first plate and the tube.

The present invention may also include a combustor having a shroud that extends circumferentially inside the combustor. The shroud defines at least one inlet passage. A first plate generally extends radially inside the shroud downstream from the at least one inlet passage. The first plate may define at least one inlet port, at least one outlet port and at least one fuel nozzle passage. A second plate extends radially around the first plate downstream from the at least one inlet port and upstream from the at least one outlet port. A sleeve is at least partially surrounded by the shroud and extends generally radially around the at least one fuel nozzle passage. The sleeve extends from the first plate radially outward from the at least one fuel nozzle passage. A first fluid flow path may be at least partially defined by the at least one inlet passage, the shroud, the sleeve and the at least one inlet port. A tube at least partially surrounded by the sleeve extends through the at least one fuel nozzle passage. A second fluid flow path is at least partially defined by the at least one outlet port, the sleeve and the tube. The second fluid flow path generally flows in an opposite and generally parallel direction to the first fluid flow path.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
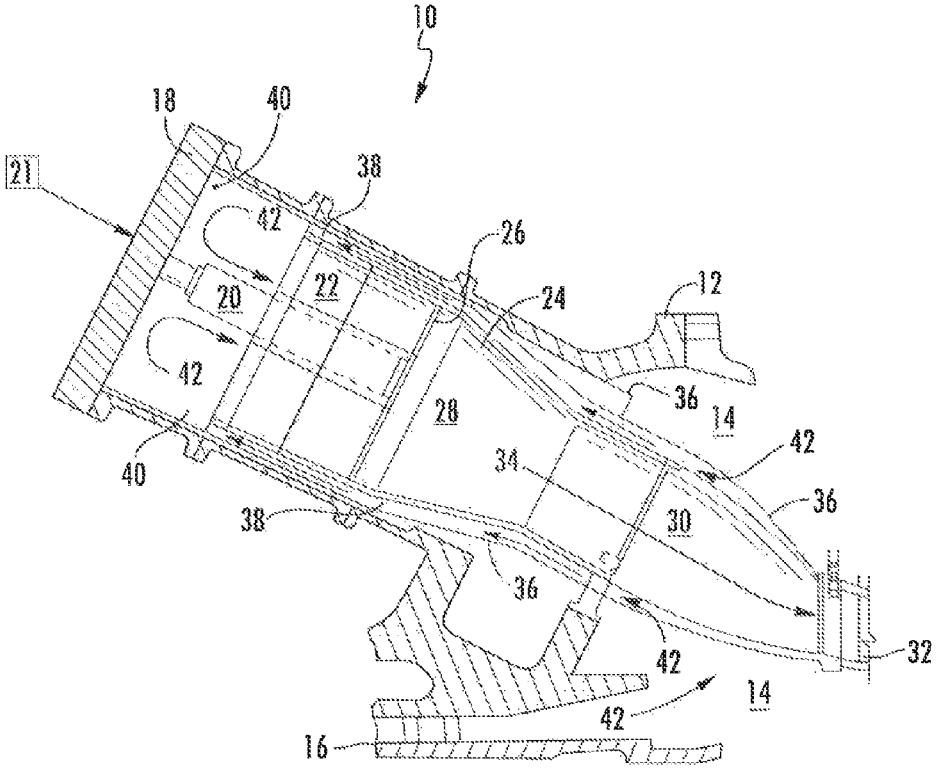
FIG. 1 PRIOR ART
FIG. 1 is a simplified cross-section of an exemplary combustor that may incorporate various embodiments of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor and a method for cooling the combustor. In particular embodiments, the combustor may generally include a shroud that extends circumferentially within at least a portion of the combustor. The shroud may generally define at least one inlet passage. A first plate may extend generally radially within the shroud generally downstream from the inlet passage. The first plate may generally define at least one inlet port, at least one outlet port, and at least on fuel nozzle passage. A second plate may extend generally radially and/or circumferentially around the first plate downstream from the at least one inlet port and upstream from the at least one outlet port. A sleeve may surround the at least one fuel nozzle passage. The sleeve may extend from the first plate generally parallel to the shroud. A tube may extend through the at least one fuel nozzle passage at least partially surrounded by the sleeve. A first fluid flow path may be generally defined from the at least one inlet passage of the shroud and the at least one inlet port of the first plate. A second fluid flow path may be generally defined from the at least one outlet port to an outlet passage at least partially defined by the tube, the first plate and the sleeve. In particular embodiments, the second fluid flow path may direct a cooling medium in a direction that is generally opposite and parallel to the first fluid flow path. In addition, the sleeve may generally separate the first and second fluid flow paths.

In operation, a cooling medium may flow through the inlet passage, into the first fluid flow path. The cooling medium may pass through the at least one inlet port and against the second plate, thereby cooling the second plate. The cooling medium may then flow through the at least one outlet port and into the second fluid flow path. In particular embodiments, the cooling medium may flow along the tube towards a head end of the combustor for mixing with a primary flow of a compressed working fluid flowing. In this manner, the cooling medium and the primary portion of the compressed working fluid may be mixed with a fuel for combustion in a combustion zone of the combustor. As a result, less unmixed working fluid may enter the combustion zone, thereby reducing NOx and/or CO2 generation and/or enhancing overall turbine efficiency.

FIG. 1 provides a simplified cross-section view of an exemplary combustor 10. As shown, the combustor 10 may generally include one or more casings 12 that at least partially define a compressor discharge plenum 14 around the combustor 10. The compressor discharge plenum 14 may be in fluid communication with a compressor 16 (partially shown) positioned generally upstream from the combustor 10. An end cover 18 may be disposed at one end of the combustor 10. One or more fuel nozzles 20 may extend from the end cover 18 and at least partially through the combustor 10. The end cover 18 and/or the one or more fuel nozzles 20 may be in fluid communication with a fuel supply 21. A cap assembly 22 may extend generally radially and axially within at least a portion of the combustor 10 and may at least partially surround at least some of the one or more fuel nozzles 20.

A generally annular combustion liner 24 may surround a downstream end 26 of the cap assembly 22. The combustion liner 24 may extend generally axially through at least a portion of the combustor 10. A combustion zone 28 may be at least partially defined within the combustion liner 24 generally downstream form the cap assembly 22 downstream end 26. A transition duct 30 may at least partially surround at least a portion of the combustion liner 24. The transition duct 30 may extend generally axially through the combustor 10 and may terminate at a point adjacent to one or more stationary nozzles 32. The combustion liner 24 and/or the transition duct 30 may at least partially define a hot gas path 34 that extends generally axially through the combustor 10. Although a combustion liner 24 is shown and described, it should be known to one of ordinary skill in the art that in alternate combustor 10 configurations, the transition duct 30 may surround the downstream end 26 of the cap assembly 22, extend axially through the combustor 10 and terminate at a point adjacent to plurality of stationary nozzles 32, thereby eliminating the necessity for the combustion liner 24.

In particular embodiments, as shown in FIG. 1, one or more flow sleeves 36 may at least partially surround the cap assembly 22, the transition duct 30 and/or the combustion liner 24 so as to at least partially define an annular passage 38 therebetween. In addition or in the alternative, the annular passage 38 may be at least partially defined between the combustion liner 24 and/or the transition duct 30, the cap assembly 22 and at least one of the one or more casings 12 that surround the combustor 10. A head end 40 of the combustor 10 may be at least partially defined between the end cover 18, at least one of the one or more casings 12 and a portion the cap assembly 22. The annular passage 38 may provide fluid communication between the compressor discharge plenum 14 and the head end 40.

In operation, a compressed working fluid 42 such as air may flow from the compressor 16 into the compressor discharge plenum 14. Generally, a primary portion of the compressed working fluid 42 flows across the transition duct 30 and or the combustion liner 24, through the annular passage 38 and into the head end 40 of the combustor 10. As the primary portion of the compressed working fluid 42 flows through the annular passage 38, friction with at least one of the transition duct 30, the combustion liner 24 or the one or more sleeves 36 and/or other flow obstructions throughout the annular passage 38, may generally result in a substantial pressure drop in the primary portion of the compressed working fluid 42 as it flows through the annular passage across the cap assembly 22 and towards the head end 40 of the combustor 10.

At least some of the primary portion of the compressed working 42 fluid may reverse direction at the end cover 18 and may flow through at least a portion of the cap assembly 22 and/or through or around the one or more fuel nozzles 20. The primary portion of the compressed working fluid 42 may mix with a fuel flowing through the one or more fuel nozzle 20, thereby providing a fuel-air mixture for combustion within the combustor 10. The fuel-air mixture flows into the combustion zone 28 where it is burned to provide a rapidly expanding hot gas. The hot gas flows along the hot gas path 34 and across the one or more stationary nozzles 32 as it exits the combustor 10. As the fuel-air mixture is burned in the combustion zone 28, a flame and/or a portion of the hot gas may reside proximate to the downstream end 26 of the cap assembly 22, thereby resulting in extremely high thermal stresses at the downstream end 26 of the cap assembly 22.

Figure 2:
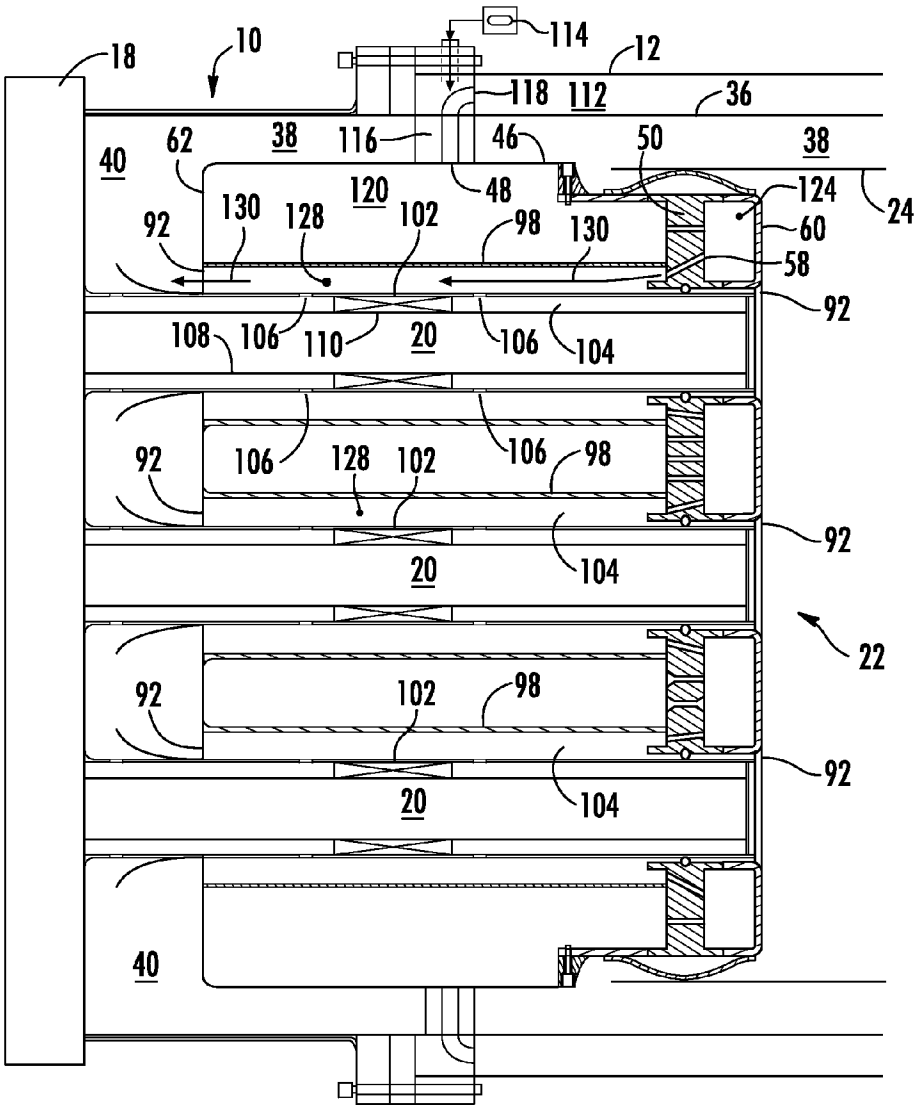
FIG. 2 is an enlarged cross section side view of a portion of the combustor as shown in FIG. 1, according to at least one embodiment of the present invention.
Figure 3:
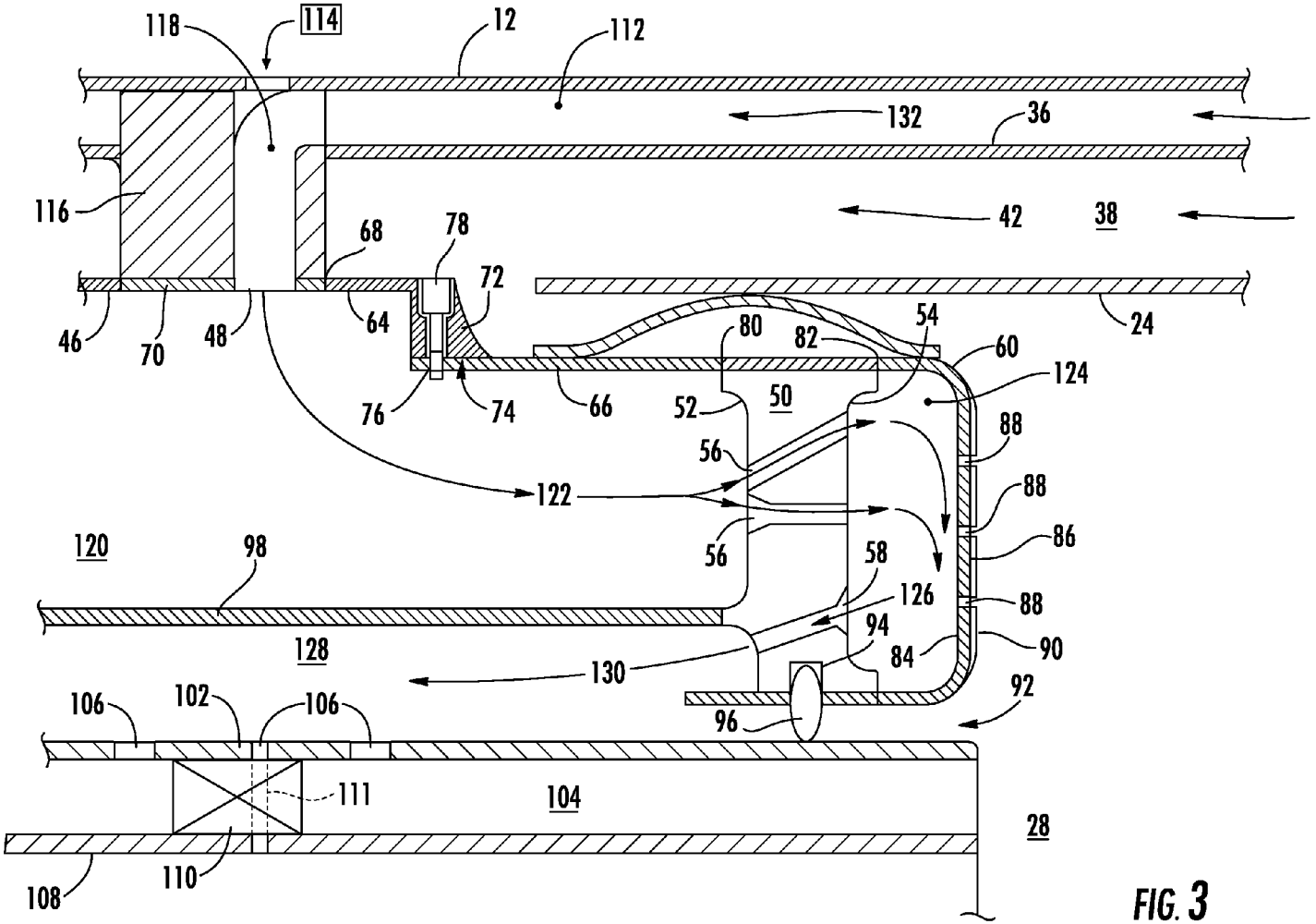
FIG. 3 is an enlarged cross section side view of a portion of the combustor as shown in FIG. 2, according to at least one embodiment of the present disclosure.

FIG. 2 provides an enlarged cross section side view of a portion of the combustor 10 according to at least one embodiment of the present disclosure, and FIG. 3 provides an enlarged cross section side view of a downstream portion the cap assembly 22 as shown in FIG. 2. As shown in FIGS. 2 and 3, the cap assembly 22 may generally include at least one shroud 46 that extends circumferentially within and axially through at least a portion of the combustor 10. At least one inlet passage 48 may be at least partially defined by at least one of the at least one shroud 46. A first plate 50 having a first side 52 axially separated from a second side 54 as shown in FIG. 3, may extend generally radially within at least one of the at least one shroud 46 downstream from the at least one inlet passage 48. As shown in FIG. 3, the first plate 50 may generally define at least one inlet port 56 and at least one outlet port 58. A second plate 60 may be disposed generally adjacent to the second side 54 of the first plate 50 downstream from the at least one inlet port 56 and upstream from the at least one outlet port 58 of the first plate 50. In particular embodiments, as shown in FIG. 2, the cap assembly 22 may further include a guide plate 62 generally adjacent to the end cover 18. The guide plate 62 may extend radially and/or circumferentially around an upstream end of at least one of the at least one shroud 46.

In particular embodiments, as shown in FIG. 3, the at least one shroud 46 may comprise of a first shroud 64 and a second shroud 66. The first and second shrouds 64, 66 may be generally coaxial. In certain embodiments, the first shroud 64 may be coupled at a first end 68 to a support ring 70 that extends generally radially and/or circumferentially within the combustor 10. In addition or in the alternative, the first shroud 64 may be coupled to another of the at least one shroud 46 and/or to at least one of the one or more casings 12. As shown, a second end 72 of the first shroud 64 may be configured to be joined to a first end 74 of the second shroud 66. For example, one or more pin slots 76 may extend generally radially though the first and second shrouds 64, 66, where each of the one or more pin slots 76 of the first shroud 64 may be generally aligned with each of the one or more pin slots 76 of the second shroud 66. In this manner, a retaining pin 78 may be inserted into the pin slots 76 to couple the first shroud 64 and the second shroud 66. In the alternative, the second shroud 66 may be welded or brazed to the first shroud 64. In further embodiments, the second shroud 66 and the first shroud 64 may be cast and/or machined as a unitary component.

In particular embodiments, as shown in FIG. 3, the first side 52 of the first plate 50 may generally include a first periphery edge 80 that extends generally circumferentially around the first side 52 of the first plate 50. A second periphery edge 82 may extend generally circumferentially around the second side 54 of the first plate 50. In particular embodiments, the first periphery edge 80 may extend generally axially away from the first side 52 of the first plate 50. In addition or in the alternative, the second periphery edge 82 may extend generally axially away from the second side 54 of the first plate 50.

As shown in FIG. 3, the at least one inlet port 56 may extend generally axially through the first plate 50 radially inward from the at least one shroud 46. The at least one inlet port 56 may be generally cylindrical, conical, oval or any shape or any combination of shapes or any size which may encourage fluid flow through the first plate 50. In particular embodiments, at least one of the at least one inlet port 56 may intersect with the second side 54 of the first plate 50 at an angle that is substantially perpendicular with the second side 54. In addition or in the alternative, at least one of the at least one inlet port 56 may intersect the second side 54 of the first plate 50 at an acute angle relative to the second side 54. As shown, the at least one outlet port 58 may extend generally axially through the first plate 50 from the second side 54 to the first side 52 and radially inward from the at least one inlet port 56. The at least one outlet port 58 may be generally cylindrical, conical, oval or any shape or any combination of shapes or any size which may encourage fluid flow through the first plate 50 from the second side 56 to the first side 52.

In particular embodiments, as shown in FIG. 3, the second plate 60 may be connected to the first plate 50 second side 56 and/or to the first plate 50 second peripheral edge 80. In alternate embodiments, the second plate 60 may be at least partially surrounded by at least one of the at least one shroud 46. In alternate embodiments, the second plate 60 may be contiguous with the at least one shroud 46. Although a generally cylindrical second plate 60 is disclosed, it should be obvious to one of ordinary skill in the art that the second plate 60 may be any shape that is generally complementary to the first plate 50. For example, but not limiting of, the second plate 60 may be wedge shaped, oval or any non-round shape.

As shown in FIG. 3, the second plate 60 may generally include a cold side 84 and a hot side 86. The second plate 60 may further define a plurality of cooling passages 88 that extend substantially axially from the cold side 84 to the hot side 86 so as to provide fluid communication through the second plate 60. In various embodiments, at least a portion of the hot side 86 of the second plate 60 may be coated with a heat resistant material 90 such as a thermal barrier coating in order to reduce thermal stresses on the second plate 60 during operation of the combustor 10.

As shown in FIGS. 2 and 3, at least one fuel nozzle passage 92 may extend generally axially through the first and second plates 50, 60. In addition, as shown in FIG. 2, the at least one fuel nozzle passage 92 may extend generally axially through the guide plate 62. The first plate 50 and/or the second plate 60 may at least partially define the at least one fuel nozzle passage 92. The at least one fuel nozzle passage 92 may be at least partially surrounded by the at least one shroud 46. As shown in FIG. 3, the first plate 50 may further define at least one seal slot 94. The seal slot 94 extends generally circumferentially and/or radially around an inner surface 95 the at least one fuel nozzle passage 92. In particular embodiments, a radial seal 96 such as a piston seal may be disposed within the at least one seal slot 94.

As shown in FIGS. 2 and 3, at least one generally annular sleeve 98 may extend circumferentially around and radially outward from the at least one fuel nozzle passage 92. The at least one sleeve 98 may extend generally axially from the first side 52 of the first plate 50 towards the head end 40 of the combustor 10. In particular embodiments, as shown in FIG. 2, the at least one sleeve 98 may extend from the first side 52 of the first plate 50 to the guide plate 62. The at least one sleeve 98 may be coupled to the first plate 50 first side 52 by any means know in the art. For example, but not limiting of, the at least one sleeve 98 may be welded or brazed to the first side 52 of the first plate 50. In the alternative, the at least one sleeve 98 may be cast and/or machined as an integral part of the first plate 50.

In particular embodiments, as shown in FIGS. 2 and 3, a tube 102 may extend at least partially through each or all of the at least one fuel nozzle passage 92. The tube 102 may be at least partially surrounded by the at least one sleeve 98. In particular embodiments, as shown in FIG. 2, the tube 102 may extend through the at least one fuel nozzle passage 92 from the first plate 50 and/or the second plate 60 to the guide plate 62 and/or to a point generally adjacent to the head end 40 of the combustor 10. As shown, the tube 102 may extend generally parallel to the at least one sleeve 98. As shown in FIGS. 2 and 3, the tube 102 may at least partially define a premix flow passage 104 for directing fuel and/or air through the cap assembly 22 into the combustion zone 28 of the combustor 10. In particular embodiments, the tube 102 may define at least one injection port 106 generally downstream from the outlet port 58 of the first plate 50. The at least one injection port 106 may be disposed anywhere along the tube 102. For example, between an upstream end of the cap assembly 22 and/or the guide plate 62, and the first side 52 of the first plate 50. The at least one injection port 106 may provide fluid communication through the tube 102 and into the premix flow passage 104.

The tube 102 may at least partially surround one of the one or more fuel nozzles 20. In the alternative, the tube 102 may be coupled to one of the one or more fuel nozzles 20. In particular embodiments, as shown in FIGS. 2 and 3, at least one of the one or more fuel nozzles 20 may comprise of a generally axially extending fluid conduit 108 coupled to the end cover 18. The fluid conduit 108 may be in fluid communication with the fuel supply 21. A plurality of turning vanes 110 may extend radially outward from the fluid conduit 108. Each or some of the plurality of turning vanes 110 may be in fluid communication with the fluid conduit 108. The plurality of turning vanes 110 may extend between the fluid conduit 108 and the tube 102. In particular embodiments, as shown in FIG. 3, the at least one injection port 106 of the tube 102 may be disposed downstream from the outlet port 58 of the first plate 50 and upstream from the plurality of turning vanes 110. In addition or in the alternative, at least one of the at least one injection port 106 may be positioned downstream from the at least one outlet port 58 of the first plate 50 and downstream from the plurality of turning vanes 110. At least some of the plurality turning vanes 110 may at least partially define one or more fluid passages 111 that extend generally radially through the turning vane 110 and through the fluid conduit 108. The passages 111 may be in fluid communication with at least one of the at least one injection port 106.

In particular embodiments, as shown in FIGS. 2 and 3, the combustor 10 may further include an outer annular passage 112 at least partially defined between the one or more flow sleeves 36 and at least one of the one or more casings 12. The outer annular passage 112 may be in fluid communication with the compressor discharge plenum 14 shown in FIG. 1, the compressor 16 and/or an external cooling medium supply 114 as shown in FIGS. 2 and 3. As shown in FIGS. 2 and 3, the combustor 10 may further include at least one strut 116 that extends generally radially between the outer annular passage 112 and the at least one shroud 46. The at least one strut 116 may extend generally axially and/or radially through the annular passage 38 at least partially defined between the cap assembly 22 and the one or more casings 12. The at least one strut 116 may at least partially define a cooling flow passage 118 that extends generally radially therethrough. The cooling flow passage 118 may be in fluid communication with the outer annular passage 112. In addition or in the alternative, the cooling flow passage 118 may be fluidly connected to the external cooling medium supply 114. In particular embodiments, as shown in FIGS. 2 and 3, the least one inlet passage 48 of the at least one shroud 46 may be generally aligned with the cooling flow passage 118.

In particular embodiments, as shown in FIGS. 2 and 3, an inlet plenum 120 may be at least partially defined by the at least one shroud 46, the sleeve 98 and the first plate 50. In addition, the inlet plenum 120 may be further defined by the guide plate 62. The at least one inlet passage 48 may provide fluid communication from the outer annular passage 112, the annular passage 38 and/or the external cooling medium supply 114 into the inlet plenum 120. As shown in FIG. 3, a first fluid flow path 122 may be at least partially defined between the at least one inlet passage 48, through the inlet plenum 120 and into the at least one inlet port 56 of the first plate 50.

As shown in FIG. 3, an intermediate plenum 124 may be at least partially defined between the first plate 50 and the second plate 60 downstream from the inlet plenum 120 and the first fluid flow path 122. In addition, the intermediate plenum 124 may be further defined by the at least one fuel nozzle passage 92. The at least one inlet port 56 may provide fluid communication between the inlet plenum 120 and the intermediate plenum 124. As shown in FIG. 3, an intermediate fluid flow path 126 downstream from the first fluid flow path 122 may be at least partially defined from the at least one inlet port 56, through the intermediate plenum 124 and into the at least one outlet port 58 of the first plate 50.

As shown in FIGS. 2 and 3, an outlet passage 128 downstream from the intermediate plenum 124 may be at least partially defined between the sleeve 98, the first plate 50 and the tube 102. As shown in FIG. 2, the outlet passage 128 may be further defined by the guide plate 62. As show in in FIGS. 2 and 3, the at least one outlet port 58 may provide fluid communication between the intermediate plenum 124 and the outlet passage 128. As shown in FIG. 3, a second fluid flow path 130 downstream from the intermediate fluid flow path 126 may be at least partially defined from the at least one outlet port 58, through the outlet passage 128 and into the head end 40 as shown in FIG. 2 of the combustor 10. In addition or in the alternative, as shown in FIGS. 2 and 3, the second fluid flow path 130 may be at least partially defined by the at least one injection port 106 extending through the tube 102 and into the premix fluid passage 104 defined within the tube 102.

Figure 4:
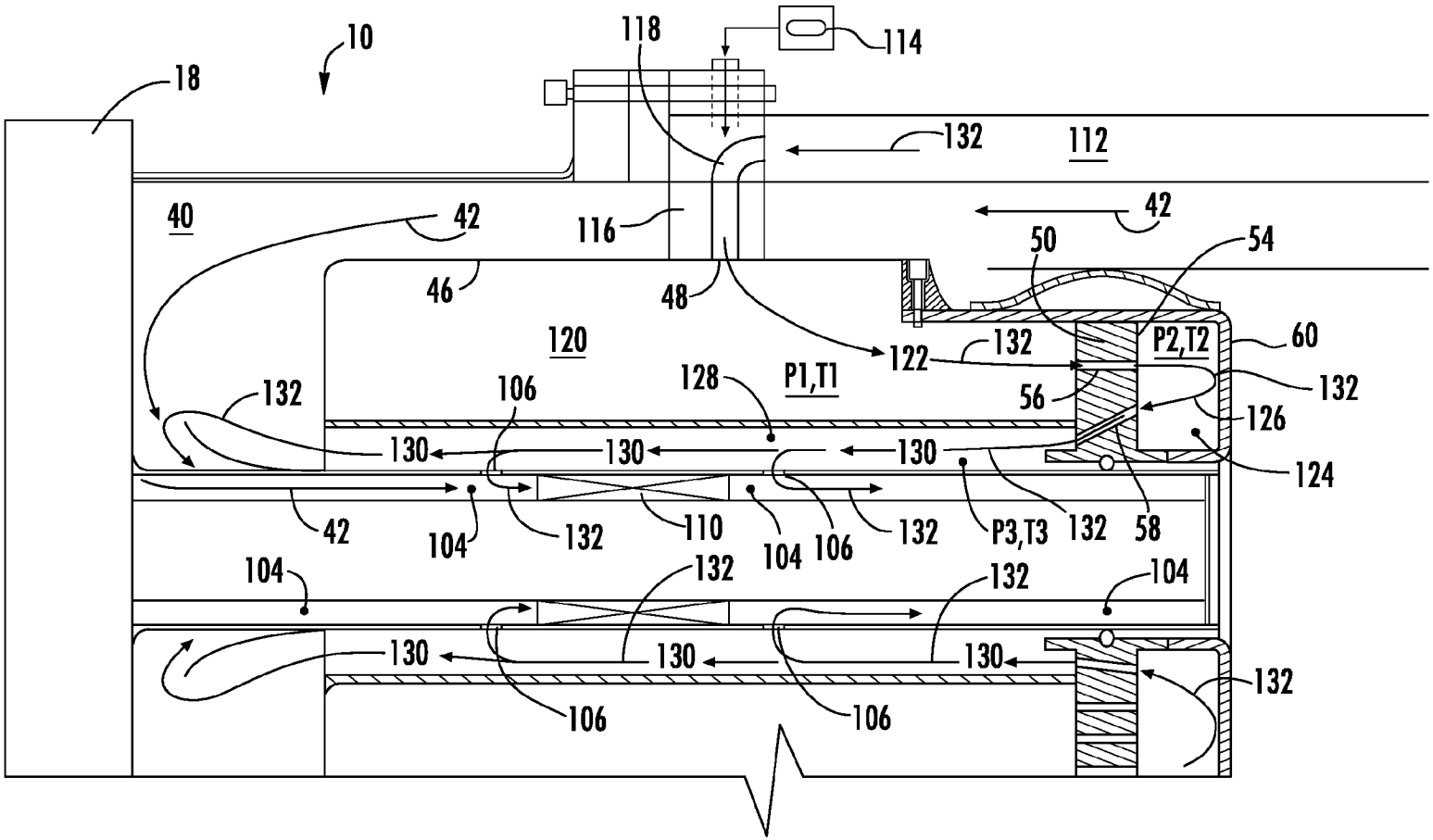
FIG. 4 is an enlarged cross section side view of a portion of the combustor as shown in FIG. 2, according to at least one embodiment of the present disclosure.

In one embodiment, as shown in FIG. 4, a pressurized cooling medium 132 such as a secondary portion of the compressed working fluid may flow through the outer annular passage 112 and or from the external cooling medium supply 114, through the cooling passage 118 of the one or more struts 116 and/or through the at least one inlet passage 48 of the at least one shroud 46 and into the inlet plenum 120. The cooling medium may flow through the inlet plenum 120 along the first fluid flow path 122 at a first pressure P1 and at a first temperature T1. The cooling medium 132 may then flow through the at least one inlet port 56 and into the intermediate plenum 124. As the cooling medium 132 flows from the inlet plenum 120 to the intermediate plenum 124, a pressure drop may occur. As a result, the cooling medium in the intermediate plenum 124 may be at a second pressure P2 that is lower than the first pressure P1. The at least one inlet 56 port may direct the cooling medium 132 at an angle substantially perpendicular to the cold side 84 of the second plate 60, thereby providing impingement cooling to the second plate 60. In addition or in the alternative, the at least one inlet port 56 may direct the cooling medium against the cold side 84 of the second plate 60 at an acute angle relative to the second side 54 of the first plate 46, thereby providing at least one of impingement, convective or conductive cooling to the second plate 60.

As the cooling medium 132 flows through the intermediate plenum 124, heat energy may be transferred from the second plate 60 to the cooling medium 132. As result, the temperature of the cooling medium 132 may be increased to a second temperature T2. The cooling medium 132 may be directed along the intermediate fluid flow path 126 and into the at least one outlet port 58. As the cooling medium 132 flows through the at least one outlet port 58 and into the outlet passage 128, a further pressure drop of the cooling medium 132 may occur, thereby resulting in a third pressure P3 in the outlet passage 128. As the cooling medium 132 flows along the second fluid flow path 130, the cooling medium 132 may be directed to the head end 40 of the combustor 10 where it may combine with the primary portion of the compressed working 42 fluid before entering the pre-mix fluid passage 104 within the tube 102. As a result, the cooling medium 132 may effectively cool the second plate 60, thereby enhancing the overall mechanical life of the cap assembly 22 and/or the combustor 10, thus resulting in a possible reduction in operating and repair costs. In addition or in the alternative, by circulating the cooling medium 132 into the flow of the primary portion of the compressed working fluid 42, more complete mixing of the fuel, the primary portion of the compressed working fluid 42 and/or the cooling medium 132 may occur. As a result, the combustor 10 may produce lower undesirable emissions, such as nitrous oxides (NOx) and/or carbon dioxide (CO2). In addition or in the alternative, the cooling medium 132 may be directed through the at least one injection port 106 upstream and/or downstream from the plurality of turning vanes 110, thereby resulting in more complete mixing of the fuel, the primary portion of the compressed working fluid 42 and/or the cooling medium 132.

Figure 5:
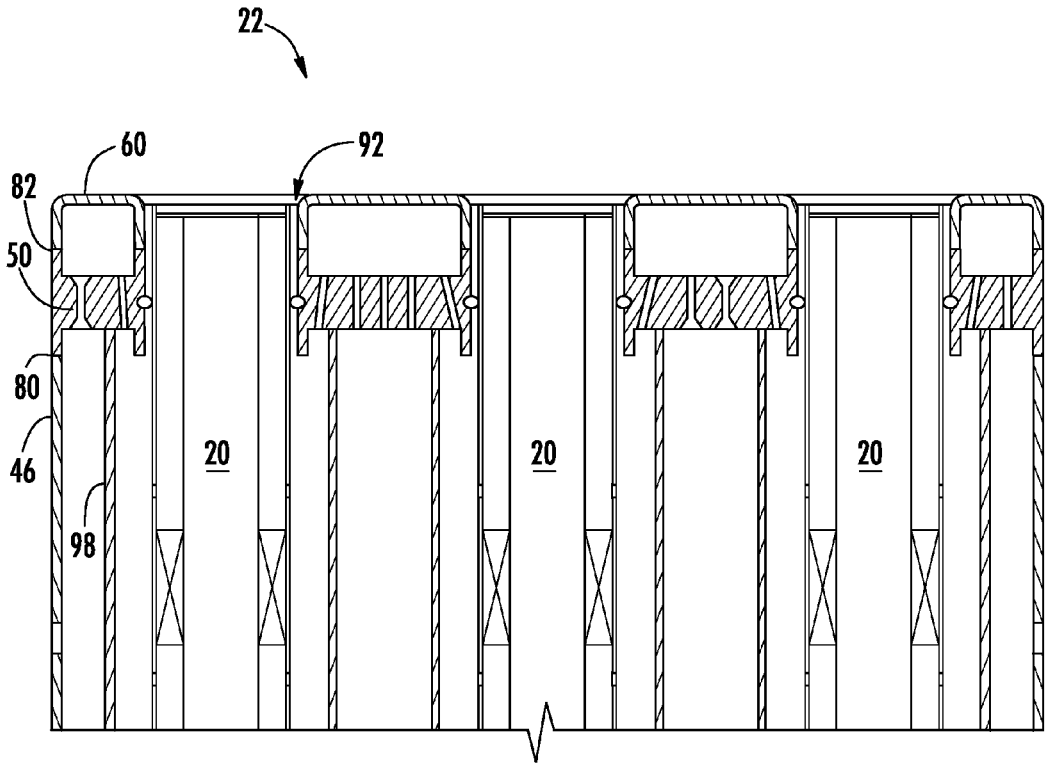
FIG. 5 is an enlarged cross section side view of the combustor as shown in FIG. 2, according to at least one embodiment of the present disclosure.
Figure 6:
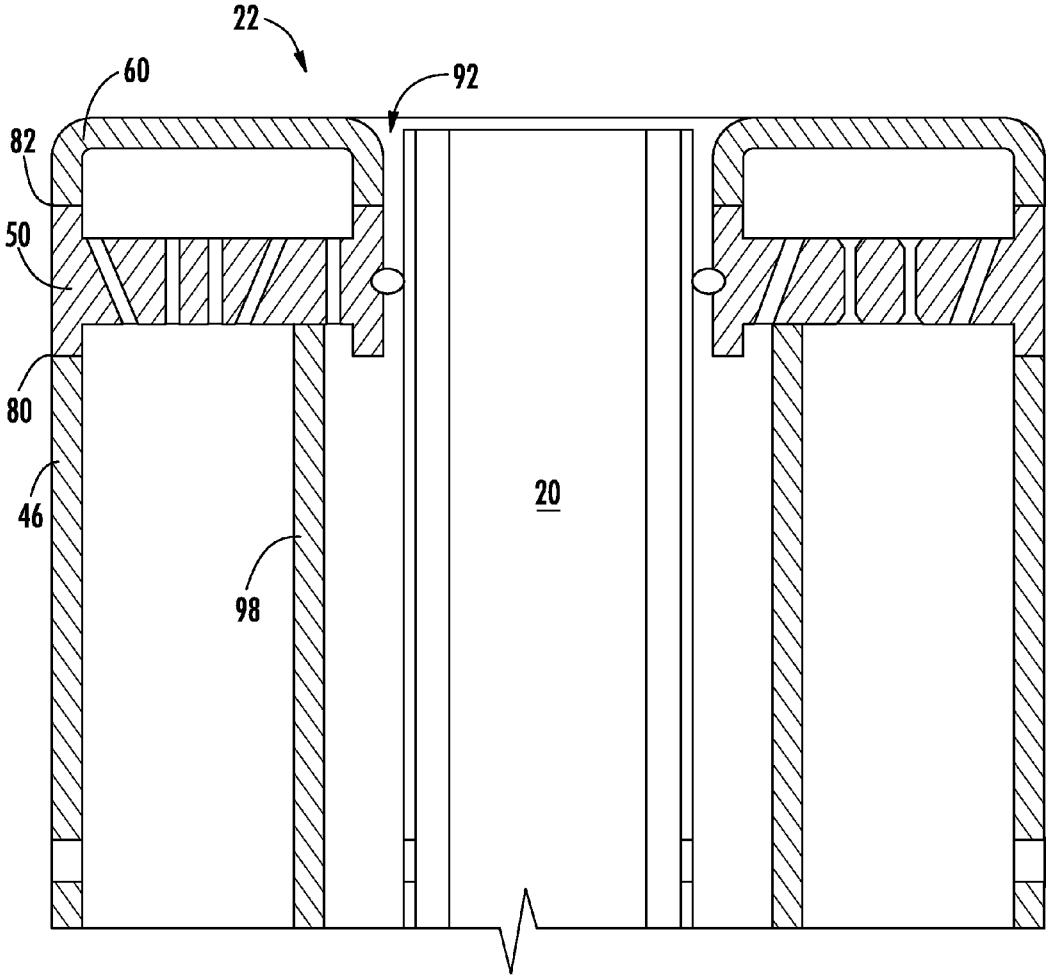
FIG. 6 is an enlarged cross section side view of the combustor as shown in FIG. 2, according to at least one embodiment of the present disclosure.

FIGS. 5 and 6 illustrate alternate embodiments of the present disclosure. As shown in FIG. 5, illustrates an embodiment having a plurality of fuel nozzles 20 extending through the cap assembly 22 as previously disclosed. In addition, FIGS. 5 and 6 illustrate at least one embodiment where the first plate provides axial separation between the second plate and the at least one shroud. For example, the at least one shroud may be connected to the first peripheral edge 80 of the first plate 50 and the second plate 60 may be connected to the second peripheral edge 82 of the first plate 50. FIG. 6 also provides at least one embodiment having a single fuel nozzle 20.

One of ordinary skill in the art will readily appreciate from the teachings herein that the various embodiments shown and described with respect to FIGS. 2-6 may also provide a method for cooling the combustor 10. The method generally includes flowing the cooling medium 132 into the inlet plenum 120 and through the first fluid flow path 122 at a first pressure P1. The cooling medium 132 may then flow through the at least one inlet port 56, through the first plate 50 and into the intermediate plenum 124. The cooling medium 132 may be directed against the second plate 60 at an angle that is substantially perpendicular to the second plate 60. In the alternative, the cooling medium 132 may intersect with the second plate 60 at an angle that is acute to the second plate 60. The cooling medium 132 may flow along the intermediate fluid flow path 126, through the at least one outlet port 58 and into the outlet passage 128 at the third pressure P3. The cooling medium 132 may then flow through the second fluid flow passage 130 to the head end 40 of the combustor 10 where it is mixed with the primary portion of the compressed working fluid 42. In the alternative, the cooling medium 132 may be directed through at least one of the at least one injection port 106 of the tube 102 upstream and/or downstream from the plurality of turning vanes 110. In addition or in the alternative, the cooling medium may flow through the one or more fluid passages 111 that extend through at least one of the plurality of turning vanes 110. The primary portion of the compressed working fluid 42 and the cooling medium 132 may be mixed with the fuel within the tube 102 before flowing into the combustion zone 28.

This written description uses examples to disclose the invention, including the best mode, and also to enable any person skilled in the art to practice the invention, including making and using any devices or combustors and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor, comprising:

a. a shroud that extends circumferentially inside the combustor, wherein the shroud defines at least one inlet passage;

b. a first plate that extends radially inside the shroud downstream from the at least one inlet passage, wherein the first plate defines at least one inlet port, at least one outlet port and at least one fuel nozzle passage;

c. a sleeve at least partially surrounded by the shroud and that extends radially around the at least one fuel nozzle passage, wherein the sleeve extends from the first plate radially outward from the at least one fuel nozzle passage;

d. a tube at least partially surrounded by the sleeve and that extends through the at least one fuel nozzle passage, wherein the tube, the sleeve, and the first plate at least partially define an outlet passage;

e. a first fluid flow path from the at least one inlet passage to the at least one inlet port; and f. a second fluid flow path from the at least one outlet port to the outlet passage.

2. The combustor as in claim 1, further comprising a seal that extends radially between the tube and the fuel nozzle passage, wherein the seal further defines the outlet passage.

3. The combustor as in claim 1, wherein the at least one inlet port is disposed between the shroud and the sleeve, and the at least one outlet port is disposed between the at least one fuel nozzle passage and the sleeve.

4. The combustor as in claim 1, wherein the shroud, the sleeve and the first plate at least partially define an inlet plenum inside the shroud.

5. The combustor as in claim 4, wherein the sleeve, the first plate and the tube at least partially defines an outlet plenum downstream from the inlet plenum.

6. The combustor as in claim 5, wherein the tube at least partially defines one or more fluid passages upstream from the at least one outlet port of the first plate.

7. The combustor as in claim 5, further comprising a second plate that extends radially around the first plate downstream from the at least one inlet port and upstream from the at least one outlet port.

8. The combustor as in claim 7, wherein the first plate and the second plate at least partially define an intermediate plenum downstream from the inlet plenum and upstream from the outlet plenum.

9. The combustor as in claim 1, further comprising a cooling medium supply, wherein the cooling medium supply is in fluid communication with the at least one inlet passage of the shroud.

10. A combustor, comprising:

a. a shroud that extends circumferentially inside the combustor, wherein the shroud defines at least one inlet passage;

b. a first plate that extends radially inside the shroud downstream from the at least one inlet passage, wherein the first plate defines at least one inlet port, at least one outlet port and at least one fuel nozzle passage;

c. a second plate that extends radially around the first plate downstream from the at least one inlet port and upstream from the at least one outlet port;

d. a sleeve at least partially surrounded by the shroud and that extends radially around the at least one fuel nozzle passage, wherein the sleeve extends from the first plate radially outward from the at least one fuel nozzle passage;

e. a tube that extends through the at least one fuel nozzle passage, wherein the tube, the sleeve, and the first plate at least partially define an outlet passage;

f. an inlet plenum inside the shroud and at least partially defined by the shroud, the first plate and the sleeve; and g. an outlet plenum downstream from the inlet plenum and at least partially defined by the sleeve, the first plate and the tube.

11. The combustor as in claim 10, further comprising a seal that extends radially between the tube and the fuel nozzle passage, wherein the seal further defines the outlet plenum.

12. The combustor as in claim 10, wherein the at least one inlet port is disposed between the shroud and the sleeve, and the at least one outlet port is disposed between the at least one fuel nozzle passage and the sleeve.

13. The combustor as in claim 10, wherein the tube at least partially defines at least one fluid passage upstream from the at least one outlet port of the first plate.

14. The combustor as in claim 13, further comprising a fuel nozzle having a plurality of turning vanes, the plurality of turning vanes at least partially surrounded by the tube, wherein at least one of the at least one fluid passage of the tube is upstream from the plurality of turning vanes.

15. The combustor as in claim 10, wherein the first plate and the second plate at least partially define an intermediate plenum downstream from the inlet plenum and upstream from the outlet plenum.

16. The combustor as in claim 10, wherein the at least one inlet passage provides fluid communication between a cooling medium supply and the inlet plenum.

17. A combustor, comprising:

a. a shroud that extends circumferentially inside the combustor, wherein the shroud defines at least one inlet passage;

b. a first plate that extends radially inside the shroud downstream from the at least one inlet passage, wherein the first plate defines at least one inlet port, at least one outlet port and at least one fuel nozzle passage;

c. a second plate that extends radially around the first plate downstream from the at least one inlet port and upstream from the at least one outlet port;

d. a sleeve at least partially surrounded by the shroud and that extends radially around the at least one fuel nozzle passage, wherein the sleeve extends from the first plate radially outward from the at least one fuel nozzle passage;

e. a first fluid flow path at least partially defined by the at least one inlet passage, the shroud, the sleeve and the at least one inlet port;

f. a tube at least partially surrounded by the sleeve and that extends through the at least one fuel nozzle passage; and g. a second fluid flow path at least partially defined by the at least one outlet port, the sleeve and the tube, wherein the second fluid flow path flows in an opposite and generally parallel direction to the first fluid flow path.

18. The combustor as in claim 17, wherein the at least one inlet port is disposed between the shroud and the sleeve, and the at least one outlet port is disposed between the at least one fuel nozzle passage and the sleeve.

19. The combustor as in claim 17, wherein the tube at least partially defines one or more fluid passages upstream from the at least one outlet port of the first plate and in fluid communication with the second fluid flow path.

20. The combustor as in claim 17, further comprising a cooling medium supply, wherein the cooling medium supply is in fluid communication with the at least one inlet passage of the shroud.

* * * * *